US007320393B2

(12) United States Patent
Aulanko et al.

(10) Patent No.: US 7,320,393 B2
(45) Date of Patent: Jan. 22, 2008

(54) CONVEYOR

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/416,173

(22) Filed: May 3, 2006

(65) Prior Publication Data

US 2006/0201778 A1 Sep. 14, 2006

Related U.S. Application Data

(63) Continuation of application No. PCT/FI2004/000643, filed on Nov. 1, 2004.

(30) Foreign Application Priority Data

Nov. 3, 2003 (FI) ..... 20031592
Nov. 6, 2003 (FI) ..... 20031611

(51) Int. Cl.
*B66B 23/24* (2006.01)

(52) U.S. Cl. ..... 198/330; 198/331; 198/335; 198/337; 198/338

(58) Field of Classification Search ..... 198/330, 198/331, 335, 337, 338
See application file for complete search history.

(56) References Cited

U.S. PATENT DOCUMENTS

| | | | | |
|---|---|---|---|---|
| 900,000 | A * | 9/1908 | Seeberger | 198/330 |
| 1,025,316 | A * | 5/1912 | Seeberger | 198/330 |
| 2,578,592 | A | 12/1951 | Pile | |
| 2,940,578 | A * | 6/1960 | Clemetsen et al. | 198/329 |
| 3,283,878 | A | 11/1966 | Rissler | |
| 3,314,517 | A | 4/1967 | Karr | |
| 3,399,758 | A | 9/1968 | Karr | |
| 3,583,325 | A * | 6/1971 | Melin | 198/324 |
| 3,595,364 | A | 7/1971 | Schoneweiss | |
| 3,623,589 | A | 11/1971 | Johnson | |
| 4,232,776 | A * | 11/1980 | Dean | 198/322 |
| 4,240,537 | A * | 12/1980 | Dunstan | 198/334 |
| 4,895,240 | A * | 1/1990 | Bruehl et al. | 198/331 |
| 5,117,960 | A | 6/1992 | Ahls et al. | |
| 5,181,595 | A | 1/1993 | Tietze et al. | |
| 5,207,308 | A | 5/1993 | Sheffield et al. | |
| 5,477,954 | A | 12/1995 | Greutter et al. | |
| 5,634,546 | A | 6/1997 | Ostermeier et al. | |
| 5,638,937 | A | 6/1997 | Birney et al. | |
| 5,881,859 | A | 3/1999 | Bianchi | |
| 6,102,186 | A * | 8/2000 | Pallinger et al. | 198/337 |
| 6,161,674 | A | 12/2000 | Aulanko et al. | |

(Continued)

FOREIGN PATENT DOCUMENTS

| | | |
|---|---|---|
| DE | 2239982 | 3/1974 |

(Continued)

*Primary Examiner*—Douglas A Hess
(74) *Attorney, Agent, or Firm*—Venable LLP; Robert Kinberg; Ryan M. Flandro

(57) ABSTRACT

An arrangement for a people mover located near a floor surface comprises a transport conveyor structure including a conveyor and a handrail having a casing. A drive machine is operatively arranged at least for moving the conveyor and the handrail. The drive machine is located above the floor surface and is installed in the transport conveyor structure, at least partly inside the casing of the handrail.

18 Claims, 4 Drawing Sheets

U.S. PATENT DOCUMENTS

| | | | | |
|---|---|---|---|---|
| 6,199,678 | B1 * | 3/2001 | Reo | 198/330 |
| 6,640,959 | B1 * | 11/2003 | Haumann et al. | 198/331 |
| 6,991,084 | B2 * | 1/2006 | Lunardi | 198/335 |
| 2004/0206603 | A1 * | 10/2004 | Lunardi | |
| 2006/0272925 | A1 * | 12/2006 | Novacek et al. | |
| 2007/0029163 | A1 * | 2/2007 | Aulanko et al. | |

FOREIGN PATENT DOCUMENTS

| | | | |
|---|---|---|---|
| GB | 2 252 287 | | 5/1992 |
| GB | 2205803 | A | 12/1998 |
| WO | WO 89/05771 | | 6/1989 |
| WO | WO 2005/075332 | A2 | 8/2005 |
| WO | WO 2005/075332 | A3 | 8/2005 |

* cited by examiner

CONVEYOR

CROSS-REFERENCE TO RELATED APPLICATIONS

This present application is a continuation of International Application No. PCT/FI2004/000643, filed Nov. 1, 2004, designating the United States and claim priority from Application No. 20031592 filed in Finland on Nov. 3, 2003 and Application No. 20031611 filed in Finland on Nov. 6, 2003, the priority of which are claimed herein. The disclosures of the above applications are incorporated herein by reference along with each and every U.S. and foreign patent and patent application mentioned below.

BACKGROUND OF THE INVENTION

The present invention relates to an arrangement for the placement of the drive machine of a people mover, such as a transport conveyor, for example a pallet conveyor or belt conveyor or equivalent, the drive machine comprising actuating elements at least for moving the conveyor and handrail of the people mover.

Transport conveyors, like escalators, are transport devices designed to move people or goods. They differ from escalators, for example, in that they are often operated in a substantially horizontal position or in a position somewhat inclined relative to their direction of motion. Such a transport conveyor has successive steps, that is pallets that form a substantially even and linear track instead of stair-like steps as in the case of escalators. Instead of successive steps, transport conveyors may also have a continuous belt, in which case the transport conveyor resembles a belt conveyor. Transport conveyors are also called moving walkways and auto-walks.

In known transport conveyors, the structure is embedded in the ground or in the floor of the building. The machinery structures in such known transport conveyors are generally placed at one end of the pallet track or conveyor or also between steps. In this case, a pit about one meter deep and several meters long is provided at each end of the transport conveyor for the drive machinery of the transport conveyor structure and for the mechanism turning the pallets. A drawback with this type of transport conveyor construction is that it requires heavy and fixed structures in the floor of the surrounding space and these have to be taken into account when the buildings are being designed. A further drawback is that, for maintenance of the machinery structure, it is necessary to open access doors located at the floor level or to partially dismantle the pallets serving as steps, and thus maintenance and repairs involve a great deal of extra work and even safety risks. A further drawback is that transferring fixed structures like this from one place to another according to changing traffic needs is completely impossible.

When the aim is to achieve flat transport conveyor structures, the machinery easily becomes a decisive factor in respect of dimensions when prior-art machines and machine placements are used.

In British patent specification No. GB2299316, FIG. 1/3 presents a structure of the above-described type as an example of prior art, in which the machinery including pallet turning equipment is placed in a pit at the end of the pallet track.

A further problem with known transport conveyors is that the passenger has to step onto the transport conveyor from one end of the conveyor and likewise to leave the conveyor from the other end, because the hand rails on either side prevent passengers from stepping onto the conveyor from a lateral direction and from leaving it in a lateral direction along the length of the transport conveyor. Persons traveling on the transport conveyor find the long access distances uncomfortable. To serve business and passenger flow access areas located laterally from transport conveyors, a fairly large space has to be reserved beside the transport conveyors because basically prior-art transport conveyors only serve persons who step onto the transport conveyor from its entry end. For long transport distances, it is often necessary to build several short successive transport conveyors to ensure that the distance to be walked to access the transport conveyor remains reasonable. This generally leads to higher costs than if a single transport conveyor extending through the entire transport distance were built.

SUMMARY OF THE INVENTION

It is an object of the present invention to overcome the above-mentioned drawbacks and to create a compact arrangement that is simple in mechanical construction and reliable in operation for the placement of the drive machine of a people mover, such as a transport conveyor or equivalent. The invention also aims at an improved usability of the transport conveyor from the passengers' point of view.

The above and other objects are accomplished by the invention in the context of a people mover of the type first mentioned above, wherein the drive machine is located above the floor surface and is installed in the transport conveyor structure, at least partly inside the casing of the handrail.

According to another aspect of the invention there is provided a people mover for passenger transport, comprising: a transport conveyor structure including a conveyor and a handrail having a casing; and a drive machine located above a floor surface located near the people mover and including a substantially flat electric motor operatively arranged at least for moving the conveyor and the handrail, wherein the drive machine is installed in the transport conveyor structure, at least partly inside the casing of the handrail.

The invention has the advantage that the machine structure does not require any pit or corresponding space specifically made for it at all, so the invention is very efficient in respect of space utilization and advantageous in respect of costs as well as flexible in regard of disposition in a desired place. Due to the low construction height of the people mover of the invention, the transport conveyor structure can be mounted directly on a base, such as an asphalt or concrete surface either outside or inside a building. Moreover, if necessary, the transport conveyor structure of the invention can be moved to another place with minor variations and at a low cost. Another advantage is that the maintenance of the machinery can be implemented more quickly, easily and safely than in known transport conveyor structures. A further advantage is that the machine drive can be easily encapsulated in a transparent material, in which case the machine constitutes an interesting visual detail for many different uses. Thanks to the fact that a substantially flat electric motor of a thickness substantially smaller than the thickness of the handrail structures is used as or in the machine drive of the transport conveyor structure, the machine drive can be placed substantially completely or at least partly inside one of the handrail casings. Preferably, equipment for the supply of electricity to the machine drive as well as the control equipment of the conveyor can be housed completely or at least partly inside one of the hand rail casings.

The transport conveyor of the invention can be so constructed that, through at least part of the length of the transport conveyor, only one handrail is provided alongside the conveyor supporting and moving the passengers. A handrail may be provided alongside only one of the longitudinal sides of the transport conveyor while the area adjacent to the other longitudinal side of the conveyor is open in a direction transverse to the transport direction of the conveyor over the entire length of the conveyor. The conveyor is thus accessible from the other longitudinal side from any point over the entire length of the conveyor. Another possible implementation is one in which access to the conveyor is prevented by a handrail on one of the longitudinal sides over the entire length of the conveyor or over part of its length while on the other longitudinal side one or more handrails or immovable barriers prevents access over a part or parts of the total length of the conveyor. The transport conveyor can also be so constructed that in a given portion of the length of the transport conveyor a handrail is only provided on a first longitudinal side while in a given second portion a handrail is only provided on a second longitudinal side, for example, so that such handrails on opposite longitudinal sides are placed at different ends of the transport conveyor. A transport conveyor like this serves equally the whole area over the length of the transport conveyor. Furthermore, because the handrail is only provided on one side of the conveyor, the transport conveyor is simple and cheap. Another advantage is that it is possible to construct a fairly long transport conveyor because the access distance from the side of the transport conveyor to the end of the transport conveyor is not such a restricting factor as in the case of earlier transport conveyors.

A transport conveyor of a low construction, either having hand rails on both sides or having no hand rail on one side, is applicable anywhere there are long corridors or large areas and where large numbers of people move. Places of application of this type include shopping centers, subway stations, hospitals, airports, exhibition facilities and the like.

BRIEF DESCRIPTION OF THE DRAWINGS

In the following, the invention will be described in detail with reference to an exemplary embodiment, and the attached drawings, wherein.

DETAILED DESCRIPTION OF THE INVENTION

Figure 1:
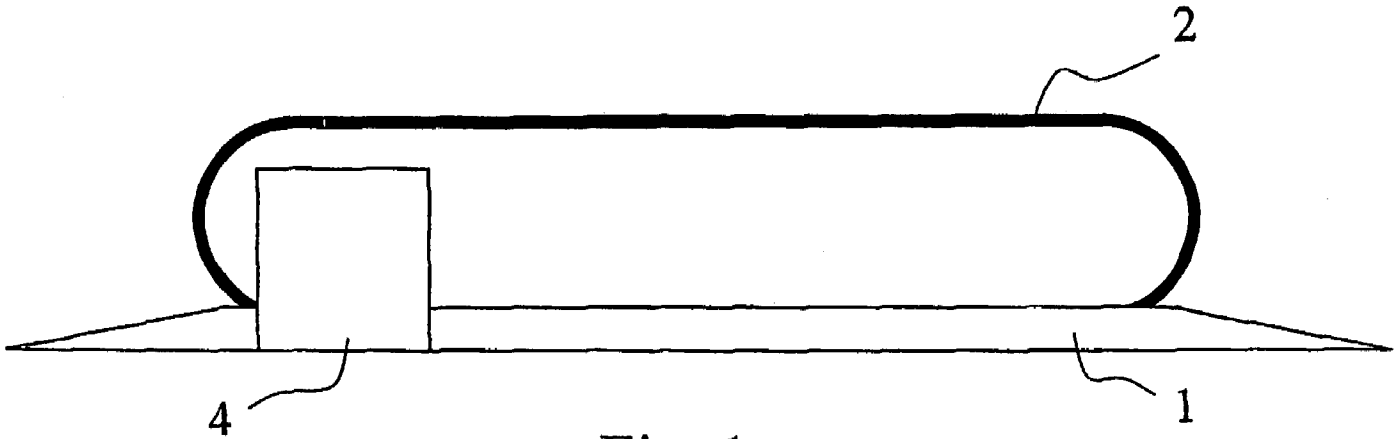
FIG. 1 presents a side view of the transport conveyor structure of the invention.
Figure 2:
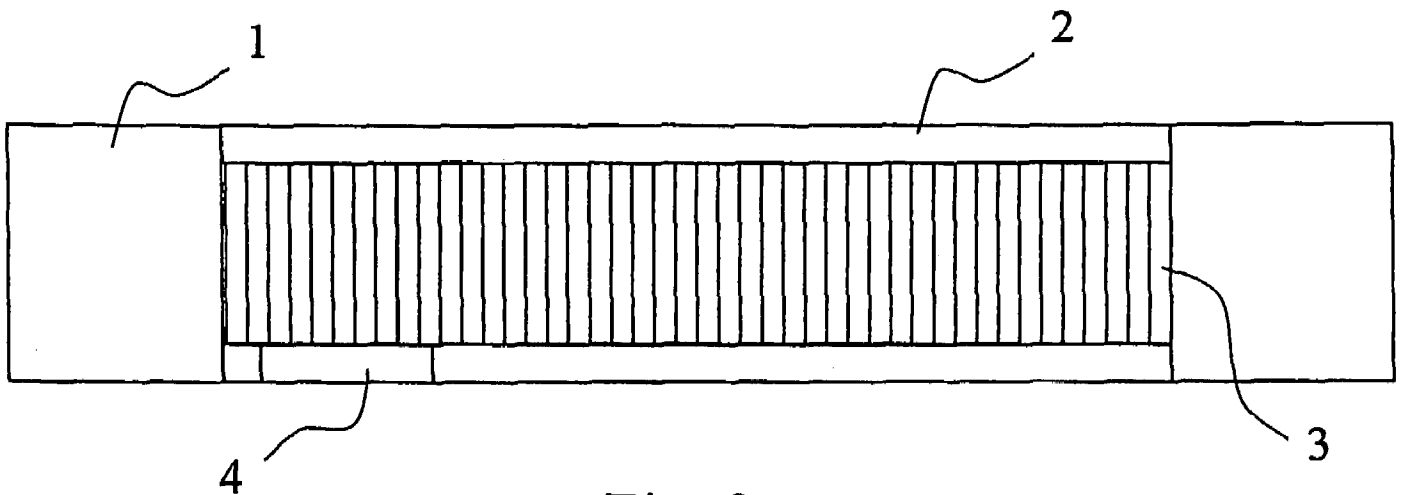
FIG. 2 presents a top view of the transport conveyor structure of the invention.

FIGS. 1 and 2 present the transport conveyor structure of the invention at a general level. The transport conveyor structure of the invention comprises a frame structure 1, whose function is to hold the equipment together and transmit the forces to the base under it. Inside the frame structure 1 is a pallet track 3, on the upper surface of which the passengers stand. In addition, the transport conveyor structure comprises at least handrails and their casings as well as a handrail drive machine 4 and the required components.

Figure 3:
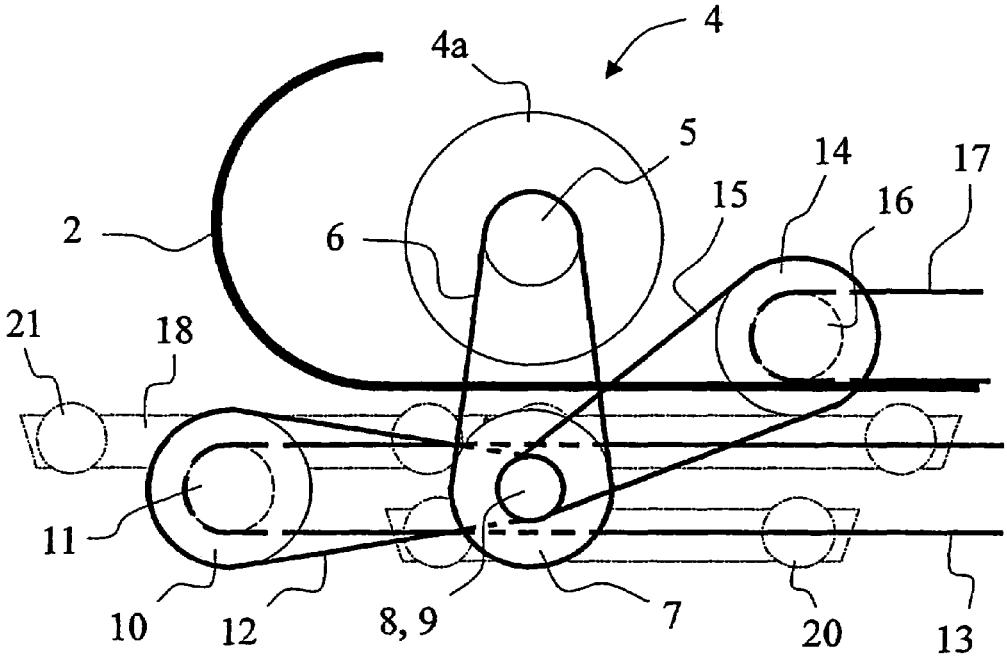
FIG. 3 presents a diagrammatic and simplified side view of the drive machine of the transport conveyor structure of the invention.
Figure 4:
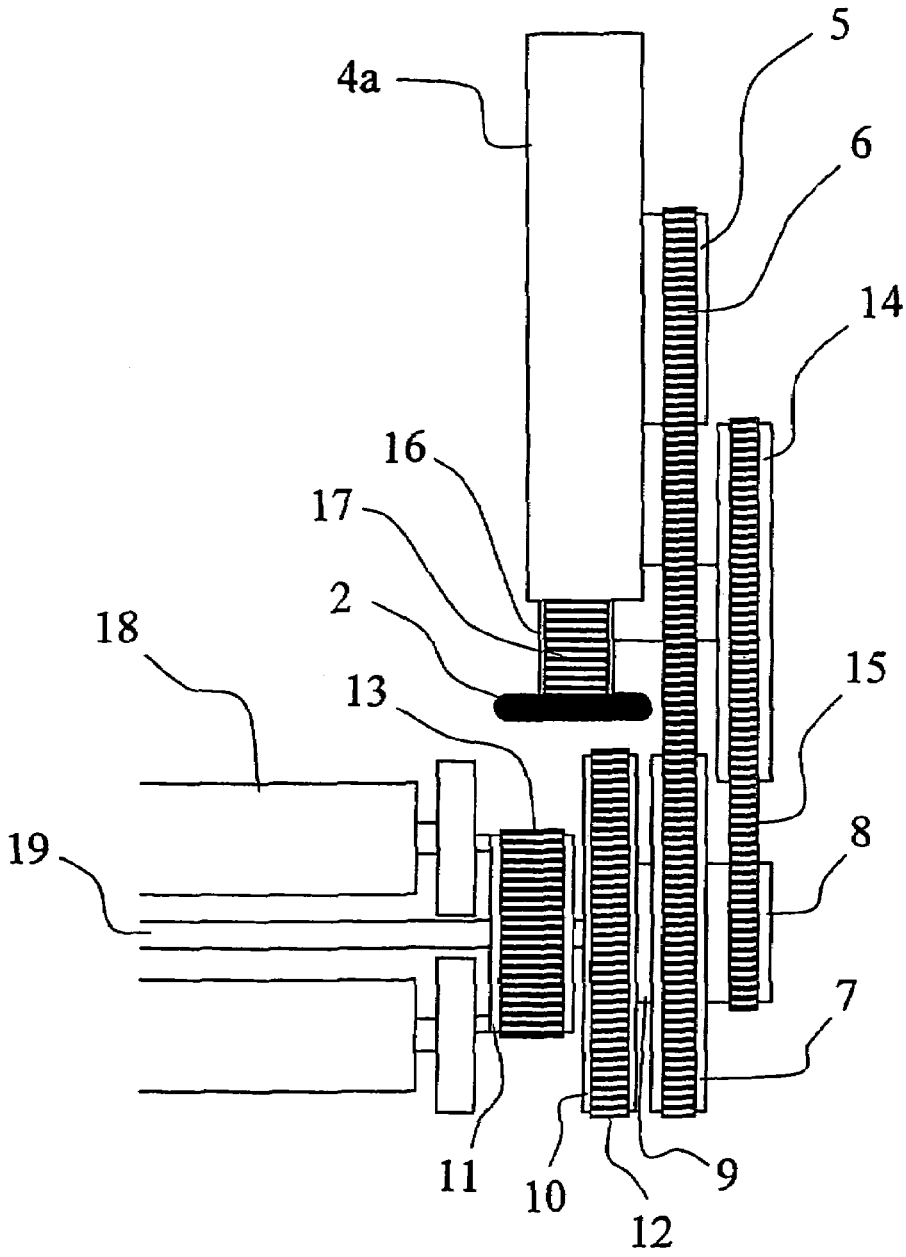
FIG. 4 presents the drive machine of the transport conveyor structure of the invention a diagrammatic and simplified view seen from the end of the transport conveyor.

FIGS. 3 and 4 illustrate the placement of the drive machine according to an exemplary embodiment of the invention in more detail, though in a simplified and diagrammatic form. In addition, the proportions and positions of different components are not necessarily accurately represented in the figures. The pallet track and handrails of the transport conveyor use a common drive machine power source 4*a*, which is a substantially flat electric motor installed in the transport conveyor structure, the motor having a thickness substantially narrower than the thickness of the handrail structures. Thus, the drive machine 4 together with the electric equipment can be housed substantially completely or at least partly inside one of the handrail casings. In addition, the entire drive machine 4 is placed above the base or supporting surface of the transport conveyor, for example, above the floor surface of the building, when the transport conveyor is mounted directly on the floor.

In the illustrated exemplary embodiment, power transmission from the power source 4*a* to different functions of the transport conveyor is implemented using cogged belts and cogged belt pulleys of different sizes. A primary belt pulley 5 connected to the electric motor either directly by the shaft of the electric motor or via a gear transmits the power by a cogged belt 6 to a secondary belt pulley 7 placed below it and having a diameter larger than that of the primary belt pulley. Mounted on the same shaft with the secondary belt pulley 7 are a belt pulley 8 for power transmission to the handrail and a belt pulley 9 for power transmission to the pallet track 3. All three of the belt pulleys 7, 8 and 9 are fixedly coupled together and rotate at the same speed about their center axis. The diameter of the secondary belt pulley 7 is larger than the diameter of the transmission belt pulleys 8, 9, which transmission belt pulleys have substantially equal diameters. In FIG. 3, due to the view angle, the transmission belt pulley 9 of the pallet track 3 is located behind the handrail transmission belt pulley 8 and the secondary belt pulley 7, so it is represented as a reference together with the handrail transmission belt pulley 8.

A cogged belt 12 drives a primary belt pulley 10 of the pallet track drive, provided in the drive machine 4, by the transmission belt pulley 9 of the pallet track 3. Fixedly attached to the primary belt pulley 10 of the pallet track drive is a pallet track drive pulley 11, whose diameter is smaller than the diameter of the pallet track drive primary belt pulley 10. Thus, these two belt pulleys 10 and 11 rotate at the same speed. The drive pulley 11 of the pallet track rotates at the speed of motion of the pallet track 3 and drives the pallet track 3, each individual pallet 18 being fastened to an endless cogged belt 13 driven by the drive pulley 11.

Similarly, the primary belt pulley 14 of the handrail drive provided in the drive machine 4, is driven by a cogged belt 15 by the transmission belt pulley 8 of the handrail 2. Fixed to the primary belt pulley 14 of the handrail drive is a handrail drive pulley 16, which has a diameter smaller than the diameter of the primary belt pulley 14 of the handrail drive. These two belt pulleys 14 and 16 thus rotate at the same speed. The handrail drive pulley 16 rotates at the same speed of motion as the handrail 2 and runs the handrail 2 by an endless drive belt 17 so that the drive belt 17 is pressed over a substantially long distance against the inner surface of the handrail 2 and while running engages the handrail by friction. To ensure a more effective engagement, the system may include a set of pressing rollers to press the lower belt portion of the drive belt loop 17 downwards against the inner surface of the lower loop of the handrail 2. Likewise, a similar set of pressing rollers may be placed against the outer surface of the lower loop of the handrail to press the outer surface of the handrail upwards against the outer surface of the drive belt 17. For the sake of clarity, the pressing rollers are not shown in the figures.

The structure of the drive machinery at the exit end of the transport conveyor may differ from the above-described structure of the entry end of the transport conveyor. In the simplest case, it is sufficient to have at the exit end a belt pulley which corresponds to the pallet track drive pulley 11 and around which the endless cogged belt 13 runs.

The pallet track consists of separate pallets 18 provided with wheels, with front wheels 20 located at the front corners of the pallet relative to the normal direction of motion of the transport conveyor and rear wheels 21 located at the rear corners of the pallet. In addition, each side edge of the pallets 18 is provided with a fastening element placed at about the middle part of the pallet relative to its direction of motion for fastening the pallet by its side edge to the cogged belt 13. The pallet 18 is fastened to the cogged belt 13 so that the fastening element allows the pallet to remain oriented in the same direction, that isq with the grooved supporting surface facing upwards and the wheels 20 and 21 substantially below the supporting surface throughout the direction-changing phase. Such a construction contributes towards achieving a low transport conveyor structure.

The pallets 18 carrying passengers, driven by the cogged belt 13 and supported by their wheels 20 and 21, move along the upper tracks, whereas the pallets moving in the return direction, supported by the same wheels, move along a return track in the frame structure or under or inside the frame structure.

FIG. 4 shows a shaft 19 mounted transversely relative to the direction of motion of the pallet track 3 and serving to transmit driving power to the other side of the pallet track. If a drive machine is provided on the other side as well, then the shaft 19 is replaced with a synchronizing shaft.

Figure 5:
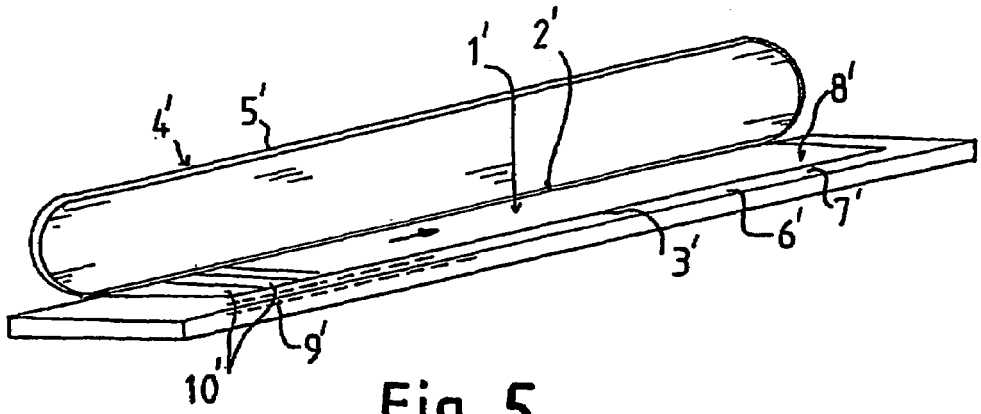
FIG. 5 presents an axonometric side view of an embodiment of the transport conveyor of the invention.

FIG. 5 presents a diagrammatic representation of a transport conveyor for passenger transport. This transport conveyor is of a low construction, designed to be mounted on a floor. The transport conveyor comprises an elongated conveyor 1' on which a person can stand or walk while the conveyor is moving the person in the transport direction indicated by the arrow.

Beside the conveyor 1' along the first longitudinal side 2' is a hand rail 4' extending in the lengthwise direction of the conveyor 1'. The handrail 4' comprises an endless handrail element 5' which moves in synchronism with the conveyor 1' and which the passenger can grip with a hand or lean against for stability. The area next to the second longitudinal side 3' of the conveyor 1' is free or open in a direction transverse to the transport direction of the conveyor 1' over the entire length of the conveyor 1'. Thus it is possible for passengers to step onto the conveyor 1' and likewise to leave the conveyor 1' from the second longitudinal side 3' at any point over the entire length of the conveyor 1'. Placed alongside the second longitudinal side 3' of the conveyor 1' is a fixed and even step plate 6' extending substantially at least through the entire length of the conveyor, the upper surface 7' of the step plate 6' being substantially at the same level with the upper surface 8' of the conveyor 1'.

The conveyor 1' has preferably a relatively narrow width, of the order of only about 50 cm. On the other hand, depending on the needs in the case of each application, the conveyor can be constructed with a width larger or smaller than this.

The conveyor 1' may be, for example, a pallet conveyor, which comprises a pallet track 9' and a number of successive pallets 10' moving on the pallet track, which have been fitted to be movable on the pallet track. The conveyor 1' may also be any other conveyor applicable for the purpose, such as a belt conveyor. Between the upper surface of the conveyor and the surrounding floor area there may be a height difference with a stair-like separation or a height difference with a ramp connection at all points or only at some points, for example at the ends of the conveyor, where passengers move onto the conveyor from the surrounding floor area or vice versa.

Figure 6:
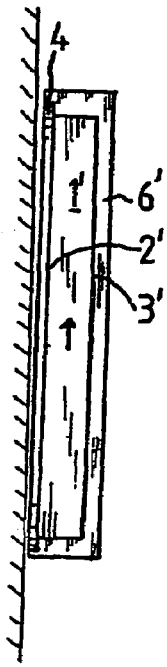
FIG. 6 presents a top view of the embodiment in FIG. 1 installed beside a wall.

FIG. 6 illustrates an a further exemplary embodiment in which the transport conveyor is placed next to a wall so that the hand rail 4' runs beside the wall.

Figure 7:
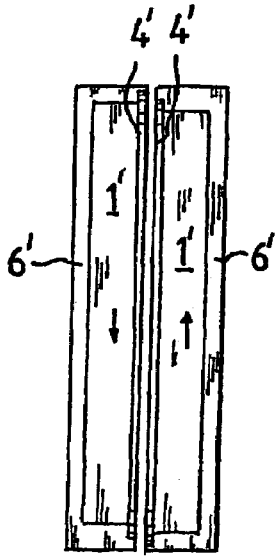
FIG. 7 presents a top view of two transport conveyors each according to FIG. 1, installed as forward and return conveyors providing transport in opposite directions.

FIG. 7 illustrates yet another exemplary embodiment in which two transport conveyors are mounted with the handrails 4' arranged adjacent each other so that the transport directions are opposite to each other. In embodiments like those illustrated in FIGS. 5, 6 and 7, the drive machine of the transport conveyor is preferably placed in a handrail that ends at the end of the transport conveyor, although other placements are also possible, especially if the conveyor is provided with several drive machines.

It is obvious to the person skilled in the art that the invention is not limited to the examples described above, but that it may be varied within the scope of the claims presented below. Thus, for example, instead of a cogged belt, the power transmission mechanism may include chains or, under certain limitations, even ropes.

It is likewise obvious to the skilled person that the lower loop of the handrail 2 may be placed completely below the drive machine 4 and beside the motion track. In certain cases, such a construction allows more space for other structural solutions in the transport conveyor.

It is further obvious that, instead of being used in a horizontal operating position, the above-described transport conveyor structure can also be used in upwards or downwards inclined positions, for example in auto ramps, escalators or equivalent. It is likewise obvious that if the power of one drive machine is insufficient to drive the whole transport conveyor, it is possible to provide the transport conveyor with several drive machines placed on either side of it. Easy placement is possible because the drive machines are mounted above the base supporting the transport conveyor, for example, above the floor, either completely clear of the floor or directly on the floor. In the case of an escalator, the frame of the people mover may be placed below the floor surface immediately associated with it while the machinery is still mainly or completely above said floor surface.

It is also obvious that instead of a belt-driven people mover as described in the exemplary embodiment above, the people mover of the invention may be based on a power transmission in which some or all of the belts are replaced with chains or other suitable elements. By using a chain drive, it is possible to achieve a somewhat narrower structure of the people mover.

It will be understood that the above description of the present invention is susceptible to various modifications, changes and adaptations, and the same are intended to be comprehended within the meaning and range of equivalents of the appended claims.

What is claimed is:

1. In an arrangement for a people mover located near a floor surface, wherein the people mover comprises:

a transport conveyor structure including:

a conveyor; and a handrail having a casing defining an inner width; and a drive machine located at least partly inside the casing of the handrail above the floor surface and operatively arranged at least for moving the conveyor and the handrail, the drive machine including a substantially flat electric motor having a thickness along a rotational axis thereof, wherein the rotational axis of the substantially flat electric motor extends perpendicular to a direction of transport defined by the conveyor and the handrail, and wherein the thickness of the substantially flat electric motor is narrower than the inner width defined by the handrail casing.

2. An arrangement according to claim 1, wherein at least the substantially flat electric motor is located completely inside the casing of the handrail.

3. An arrangement according to claim 1, wherein the drive machine is located completely inside the handrail.

4. An arrangement according to claim 1, wherein the floor surface serves as a base supporting the people mover, and the drive machine is located on the floor surface.

5. An arrangement according to claim 1, wherein the drive machine has a thickness that is smaller than the inner width of the casing of the handrail.

6. An arrangement according to claim 1, further comprising at least an additional drive machine located at least partly inside the casing of the handrail.

7. An arrangement according to claim 6, wherein the transport conveyor structure includes at least two handrails, and the drive machine and the additional drive machine are each located at least partly inside a respective casing of each handrail.

8. An arrangement according to claim 1, wherein the drive machine is encapsulated in a transparent material.

9. A people mover for passenger transport, comprising:

a transport conveyor structure including a transport conveyor and a handrail having a casing defining an inner width; and a drive machine located at least partly inside the casing of the handrail and substantially above a floor surface located near the people mover, the drive machine including a substantially flat electric motor having a thickness along a rotational axis thereof and being operatively arranged at least for moving the conveyor and the handrail, wherein the rotational axis extends perpendicular to a direction of transport defined by the conveyor and the handrail, and wherein the thickness of the substantially flat electric motor is narrower than the inner width of the handrail casing.

10. The transport conveyor according to claim 9, wherein there is only one handrail adjacent to the conveyor over a portion of a longitudinal length of the conveyor.

11. The transport conveyor according to claim 10, wherein the handrail includes an endless handrail element which moves in synchronism with the conveyor and extends in the direction of transport of the conveyor, the handrail being arranged for being gripped by a hand of a passenger or to be leaned against by a passenger for stability.

12. The transport conveyor according to claim 10, wherein the conveyor has first and second longitudinal sides, the handrail is located adjacent to the first longitudinal side of the conveyor, and an area adjacent to the second longitudinal side of the conveyor is open in a direction transverse to the direction of transport of the conveyor over the entire length of the conveyor, whereby the conveyor is accessible from the second longitudinal side from any point over the entire length of the conveyor.

13. The transport conveyor according to claim 12, further including a fixed step plate arranged beside the second longitudinal side of the conveyor and extending substantially at least over the entire length of the conveyor.

14. The transport conveyor according to claim 13, wherein the step plate has an upper surface that is substantially at the same level with an upper surface of the conveyor.

15. The transport conveyor according to claim 9, wherein the conveyor is of low construction and adapted to be mounted on the floor surface.

16. The transport conveyor according to claim 9, wherein the conveyor has a width of about of 50 cm.

17. The transport conveyor according to claim 9, wherein the conveyor includes a pallet track and a number of successive pallets fitted to be movable on the pallet track.

18. The transport conveyor according to claim 9, wherein the conveyor is a belt conveyor.

* * * * *